US006520823B2

(12) United States Patent
Tian et al.

(10) Patent No.: US 6,520,823 B2
(45) Date of Patent: Feb. 18, 2003

(54) REMOTE ELECTRO-AEROPLANE

(75) Inventors: Yu Tian, Shanghai (CN); Wenyan Jiang, Shanghai (CN)

(73) Assignee: Shanghai Helang Electronics Co., Ltd., Shanghai (CN)

( * ) Notice: Subject to any disclaimer, the term of this patent is extended or adjusted under 35 U.S.C. 154(b) by 0 days.

(21) Appl. No.: 09/834,885

(22) Filed: Apr. 16, 2001

(65) Prior Publication Data

US 2002/0061698 A1 May 23, 2002

(30) Foreign Application Priority Data

Jul. 14, 2000 (CN) ..... 00218417 U

(51) Int. Cl.[7] ..... A63H 27/00
(52) U.S. Cl. ..... 446/57; 446/454
(58) Field of Search ..... 446/34, 49, 50, 446/61, 62, 63, 66, 67, 68, 454, 57

(56) References Cited

U.S. PATENT DOCUMENTS 3,157,960 A * 11/1964 Schutz et al. ..... 102/348
3,408,767 A * 11/1968 Anderson ..... 446/62
3,839,818 A * 10/1974 Heggedal ..... 446/62
3,857,194 A * 12/1974 Guttman ..... 446/36
3,943,657 A * 3/1976 Leckie ..... 446/62
3,956,529 A * 5/1976 Addison ..... 244/126
4,863,412 A * 9/1989 Mihalinec ..... 446/62
4,997,688 A * 3/1991 Hardman ..... 156/307.5
5,046,979 A 9/1991 Ragan et al.
5,423,706 A * 6/1995 Chase ..... 446/213
6,327,994 B1 * 12/2001 Labrador ..... 114/382
6,349,902 B1 * 2/2002 Cripe ..... 244/153 R

FOREIGN PATENT DOCUMENTS

EP 0452646 10/1991
WO WO9736660 10/1997

* cited by examiner

*Primary Examiner*—Derris H. Banks
*Assistant Examiner*—Faye Francis
(74) *Attorney, Agent, or Firm*—Rabin & Berdo, P.C.

(57) ABSTRACT

A remote electro-aeroplane is mainly characterized in that the turn rudder surface is jointed to the tail stabilizer by a plastic film on their upper faces with a separation of the elastic foaming material from the plastic film on their lower faces at their joint, wherein two flexible cables or nylon wires are connected to the left and the right racks arranged on the left and the right turn rudder surfaces with their one end respectively and to the servo means within the remote receiving device with their another end, and the restoration mechanisms are provided beneath the left and the right turn rudder surfaces respectively. Based on this structure, the aeroplane has the advantages of easy control with smooth fly in case of making a turn, and is particularly suitable for the primary player.

7 Claims, 10 Drawing Sheets

REMOTE ELECTRO-AEROPLANE

FIELD OF THE INVENTION

The invention relates to a model aeroplane and, in particular, to a remote electro-aeroplane.

BACKGROUND OF THE RELATED ART

Conventionally, the empennage of a model aeroplane typically consists of a stabilizer and a control rudder surface having single-piece structure and controlled by two servos. Depending on their empennages, there are two types of model aeroplane in general: elevator-rudder type and V-tail type. In the elevator-rudder type plane, the elevator and the rudder are controlled respectively by two servos arranged in a remote control unit within the body, and the elevator as well as the rudder are adjusted at the same time to prevent the plane from spiral down when it makes a turn. Thus, the operation of it is so complicated that it often brings about spiral down against normal fly due to any operation mistake, and is hard to master for primary players. In the V-tail type plane, its left and right control surfaces are also controlled by two servos through two control rods respectively, and only enabled to move up or down at the same time when the steering rod is operated in case of the plane turning a corner. As a result, the plane often spirals down. To prevent substantially from spiral down during the plane making a turn, the solution in prior art is a simultaneous operation of the elevating rod for compensating the loss of lift due to turning however, it makes the aeroplane complicated in structure with troublesome operations.

SUMMARY OF THE INVENTION

An object of the invention is to provide a remote electro-aeroplane, particularly intended for primary players, having a simple structure with easy control and capable of maintaining steady fly in case of turning a corner.

To achieve said object, the invention provides a remote electro-aeroplane comprising a body, a wing, a power means, a remote receiving means and a V-type empennage comprised of a left tail stabilizer, a left turn rudder surface, a right tail stabilizer and a right turn rudder surface made of elastic foaming material and having a layer of plastic film attached on their upper and lower surfaces, characterized in that the left turn rudder is jointed to the left tail stabilizer by the plastic film attached on their upper surfaces with a separation of the elastic foam from the plastic film on lower surface at their joint, forming a cross-section of the left tail stabilizer and a cross-section of the left turn rudder surface at the joint respectively, and the right turn rudder surface is jointed to the right tail stabilizer in same manner, forming a cross-section of the right tail stabilizer and a cross-section of the right turn rudder surface at their joint respectively, wherein a left rack and a right rack are arranged on the left and the right turn rudder surfaces respectively, a left flexible cable is connected to the upper section of rudder surface for the left rack with its one end and to a servo means within the remote receiving means with its another end, a right flexible cable is connected to the upper section of rudder surface for the right rack with its one end and to a servo means within the remote receiving means with its another end, and the restoration mechanisms are provided beneath the left and the right turn rudder surfaces respectively.

The restoration mechanism is a rubber band with its one end fixed on the lower surface of the tail stabilizer and its another end fixed on the lower surface of the corresponding turn rudder surface.

Alternately, the restoration mechanism is a single rubber band with its one end connected to the lower section of rudder surface for the left rack and its another end connected to the lower section of rudder surface for the right rack via the front of the tail rack fixed between the tail pole and the joint of left and right empennages.

Furthermore, the servo means comprises a servo or two electromagnets, and the flexible cable can replaced by a nylon wire.

Comparing to the counterpart in prior art, the aeroplane according to the invention needs only one control rod to operate, and has the advantages of a simple structure with easy control to prevent from spiral down during the aeroplane turning a corner.

DESCRIPTION OF PREFERRED EMBODIMENTS

Figure 1:
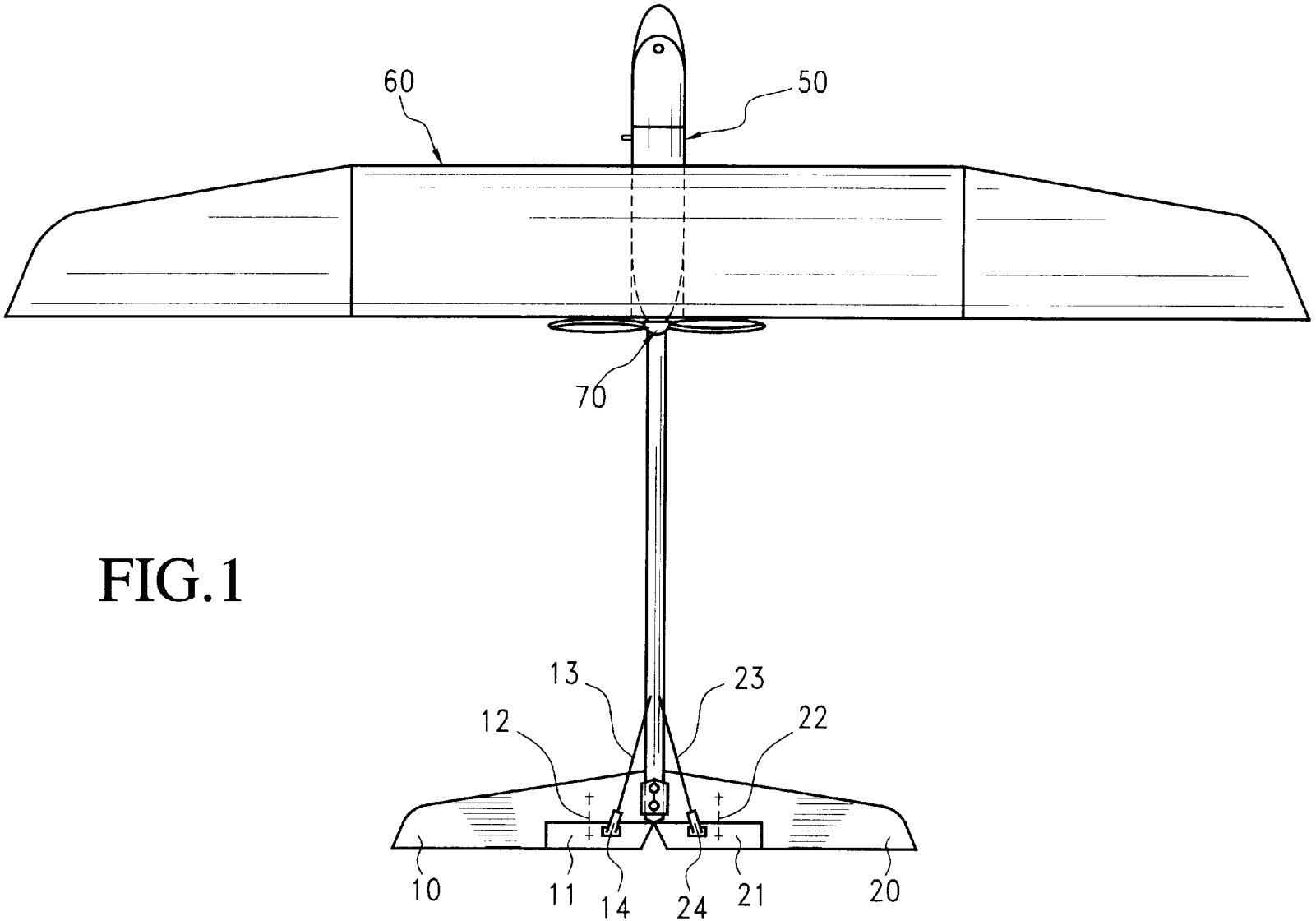
FIG. 1 is a schematic drawing of the structure in a preferred embodiment of the invention.
Figure 2:
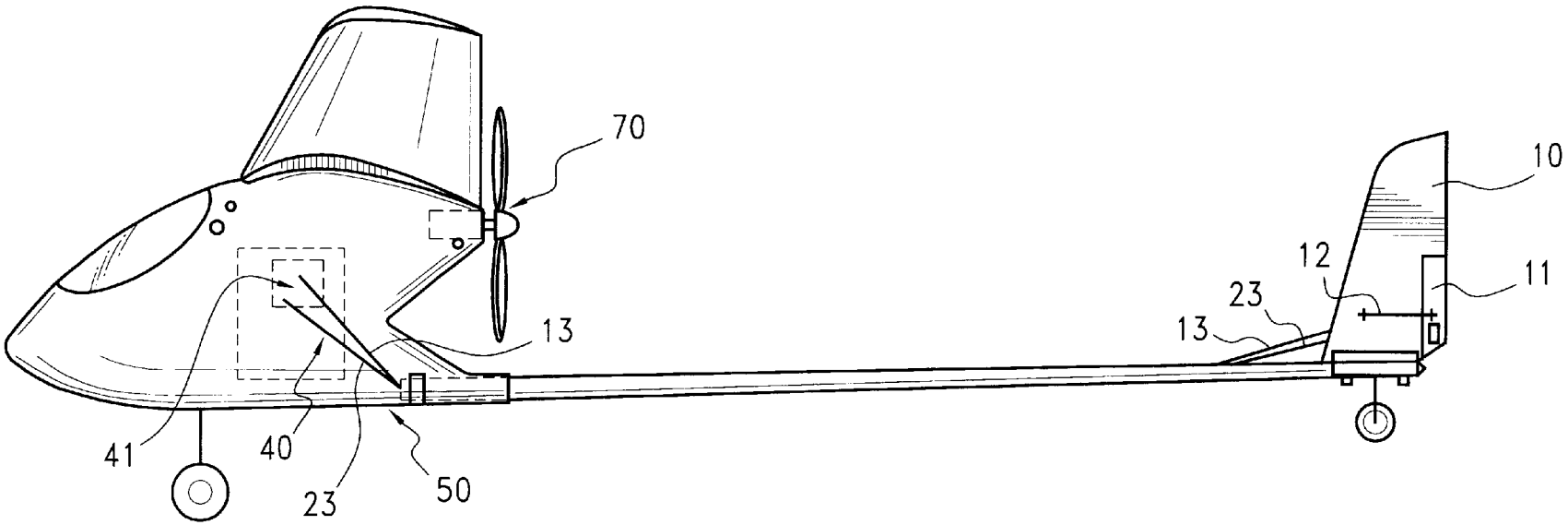
FIG. 2 is a side view of the structure in FIG. 1.
Figure 3:
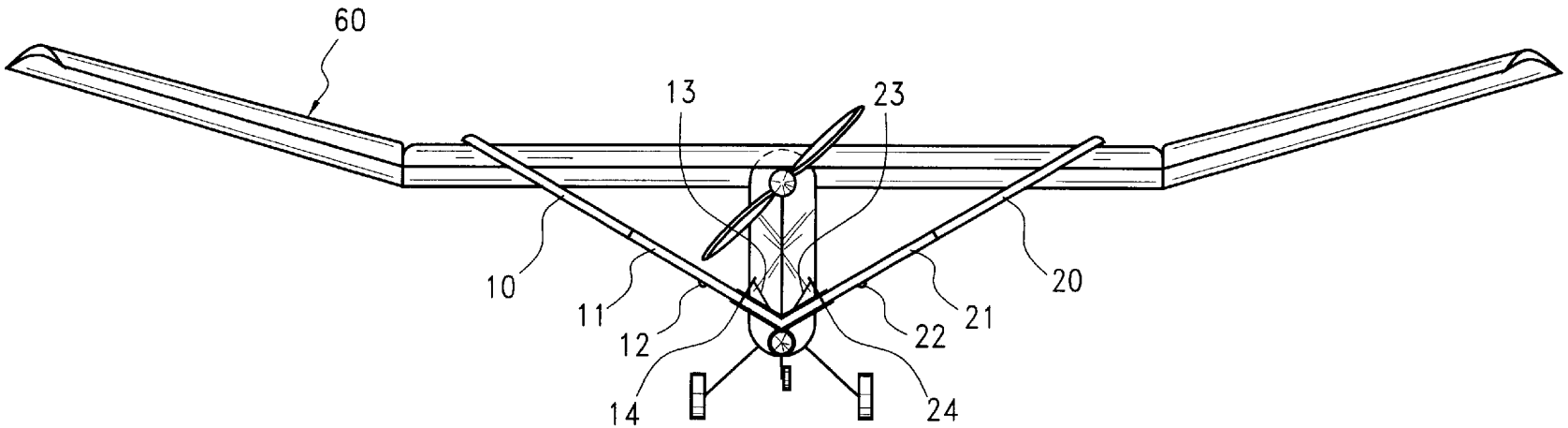
FIG. 3 is a rear view of the structure in FIG. 1.

Referring to FIG. 1 through FIG. 5, a preferred embodiment of the invention is shown. The aeroplane according to the preferred: embodiment of the invention comprises a body 50, a wing 60, a power device 70, a remote receiving device 40 and a V-type empennage composed of a left tail stabilizer 10, a left turn rudder surface 11, a right tail stabilizer 20 and a right turn rudder surface 21. Generally, the empennage is made of elastic foaming material with a layer of plastic film attached on the upper and lower surfaces. The invention is improved in that the left turn rudder surface 11 is jointed to the left tail stabilizer 10 by the plastic film attached on their upper surface with a separation of the elastic foam from the plastic film on their lower surface at their joint, forming a cross-section 15 of the left tail stabilizer 10 and a cross-section 16 of the left turn rudder surface at the joint respectively due to the thickness of elastic foam. The right tail stabilizer 20 is jointed to the right turn rudder surface 21 in the same manner, and cross-section 25 of the right tail stabilizer 20 and a cross-section 26 of right turn rudder surface are formed at the joint respectively. On the upper faces of the left and the right turn rudder surfaces 11 and 21, there are a left and a right racks 14, 24 respectively. A left flexible cable 13 is connected to the left rack 14 with its one end and to a servo 41 in the remote receiving device 40 with its another end. Similarly, a right flexible cable 23 is connected to the right rack 24 and the servo. Two restoration mechanisms 12 and 22 are provided beneath the left and the right turn rudder surfaces 11 and 21 respectively. They may adopt rubber bands with better elasticity, two ends of which are fixed on the lower face of the tail stabilizer and the lower face of the corresponding turn rudder surface respectively.

When the remote electro-aeroplane according to the invention is flying straightforwardly, as shown in FIG. 1, the left tail stabilizer 10 and the left turn rudder surface 11 are in a same horizontal plane, and their cross-section 15 and cross-section 16 are met and coincided with each other; also, the right tail stabilizer 20 and the right turn surface 21 are in a same horizontal plane, and their cross-sections 25 26 are met and coincided with each other.

Figure 4:
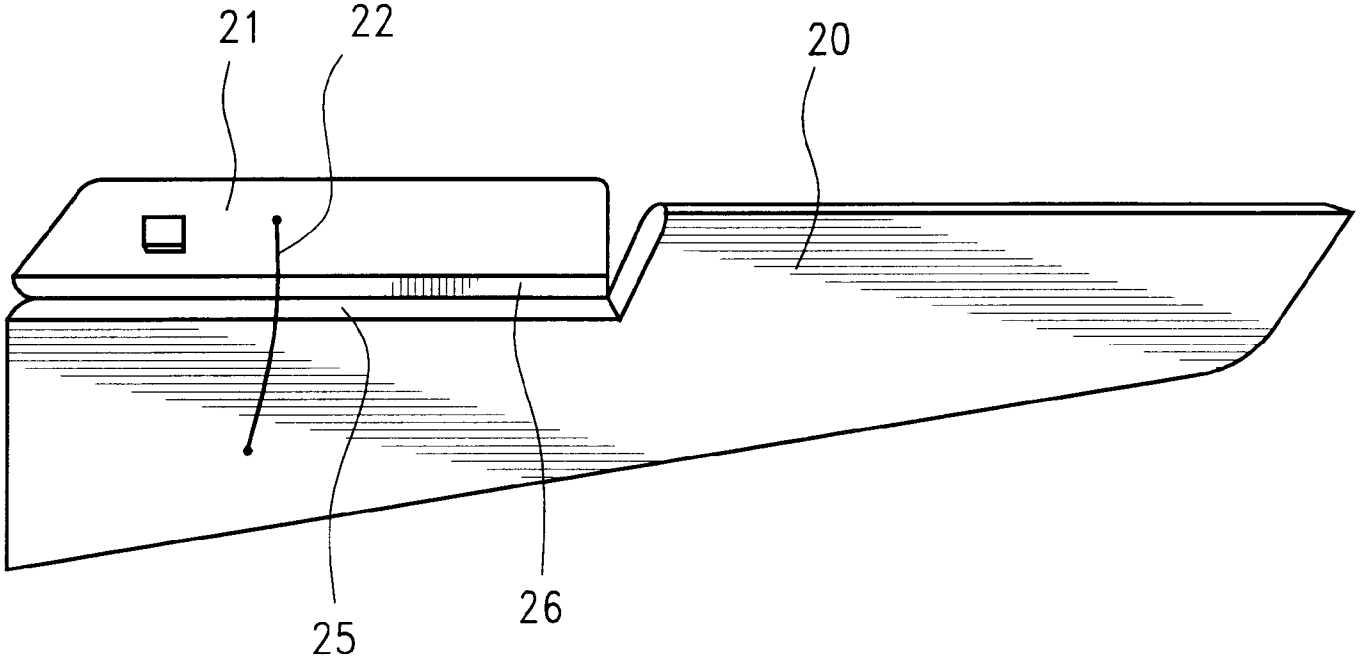
FIG. 4 is an enlarged perspective view of right empennage during left turn for the embodiment shown in FIG. 1.

When the aeroplane is turning left, as shown in FIG. 1 and FIG. 4 , under the control from the remote receiving device 40, the servo 41 turns in anti-clockwise direction to drive the right flexible cable 23 connected on it, thereby the right turn rudder surface 21 is pulled up by the right flexible cable 23 through the right rack 24. Meanwhile, although the servo 41 turns left to drive the left flexible cable 13, the left turn rudder surface can not be pushed down through the left rack, since the cable 13 is flexible, and maintains its original position because of the cross-section 15 and the cross-section 16 leaned against each other. When the aeroplane changes its turning fly to straightforward fly, the right flexible cable 23 will be restored by the control to the servo 41 in the remote receiving device 40, while the right turn rudder surface 21 will be restored by a back pull spring from the restoration mechanism 22, and will not be pulled to the downward position by such spring because its cross-section 26 will rest against the cross-section 25 of the right tail stabilizer 20.

Figure 5:
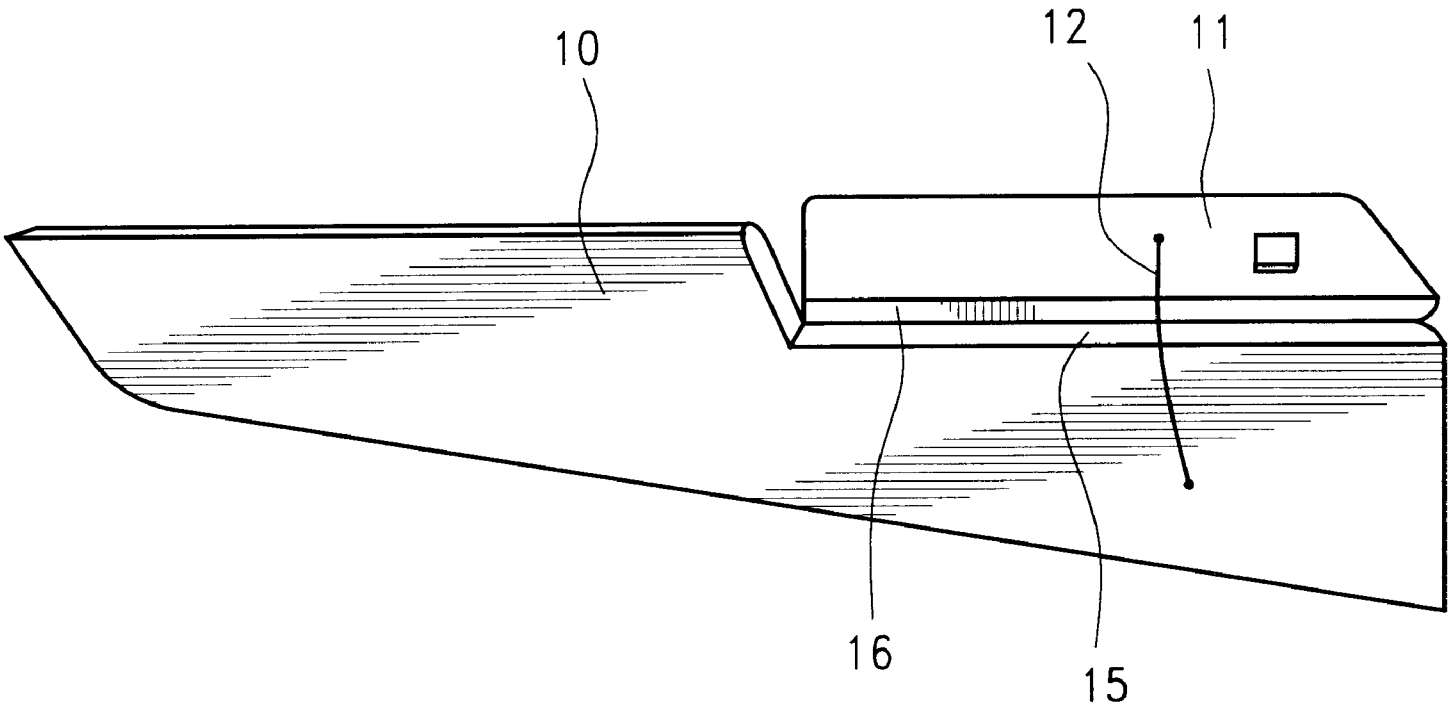
FIG. 5 is an enlarged perspective view of left empennage during right turn for the embodiment shown in FIG. 1.
Figure 6:
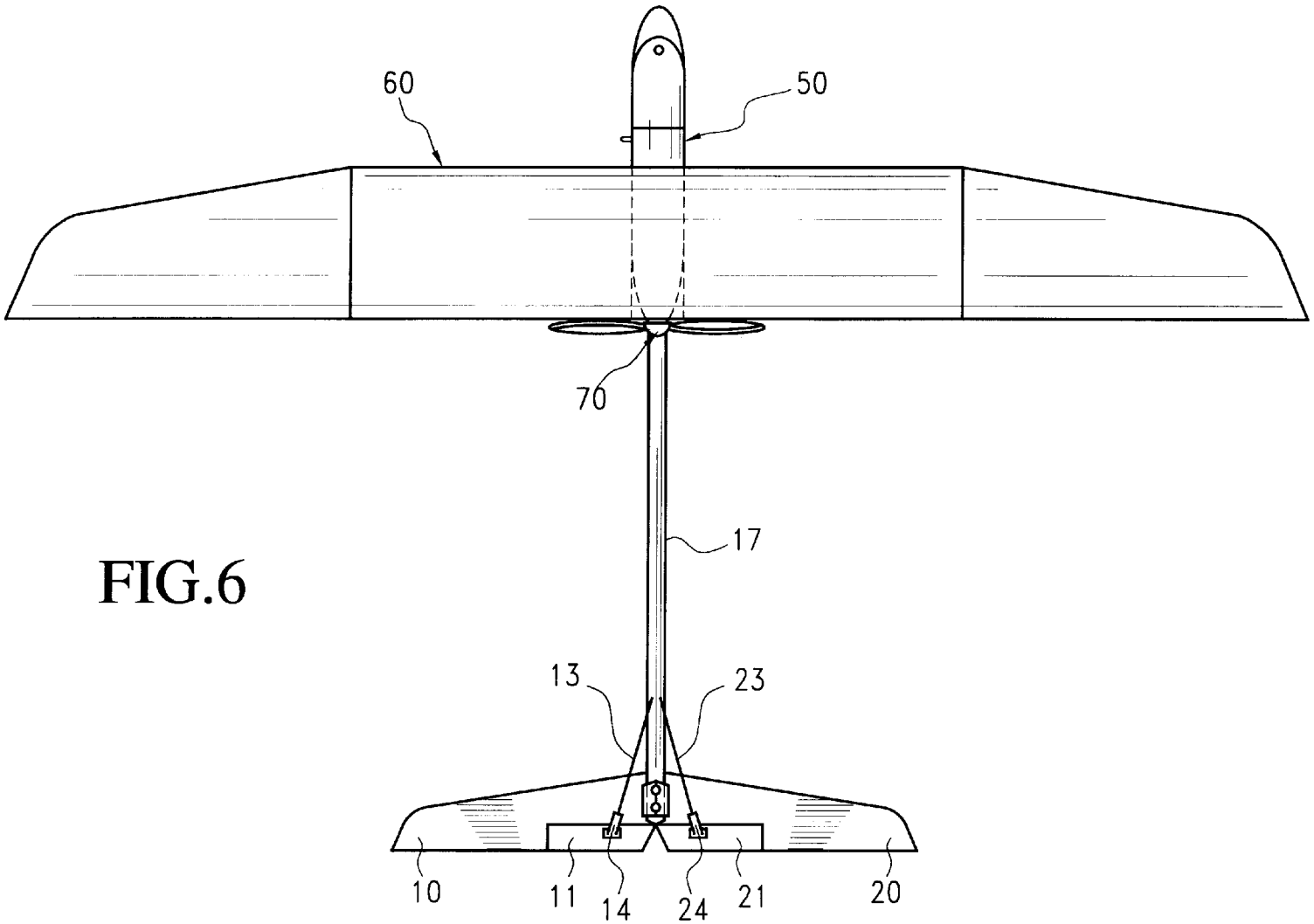
FIG. 6 is a schematic drawing of the structure in another preferred embodiment of the invention.
Figure 7:
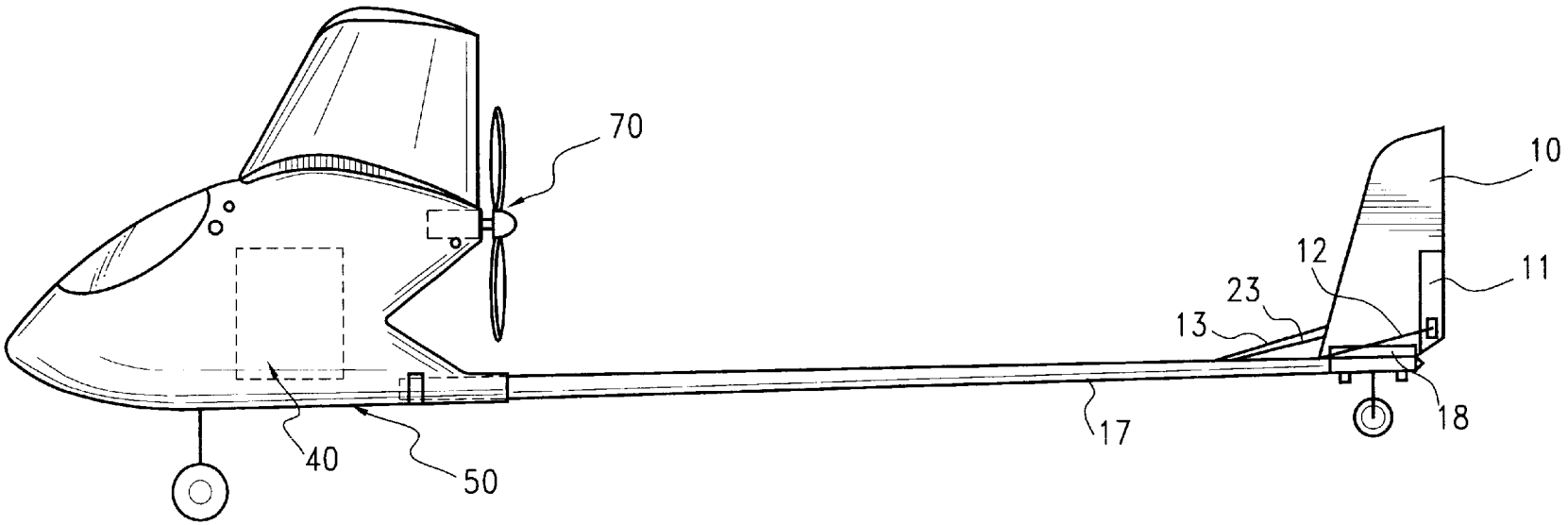
FIG. 7 is a side view of the structure in FIG. 6.
Figure 8:
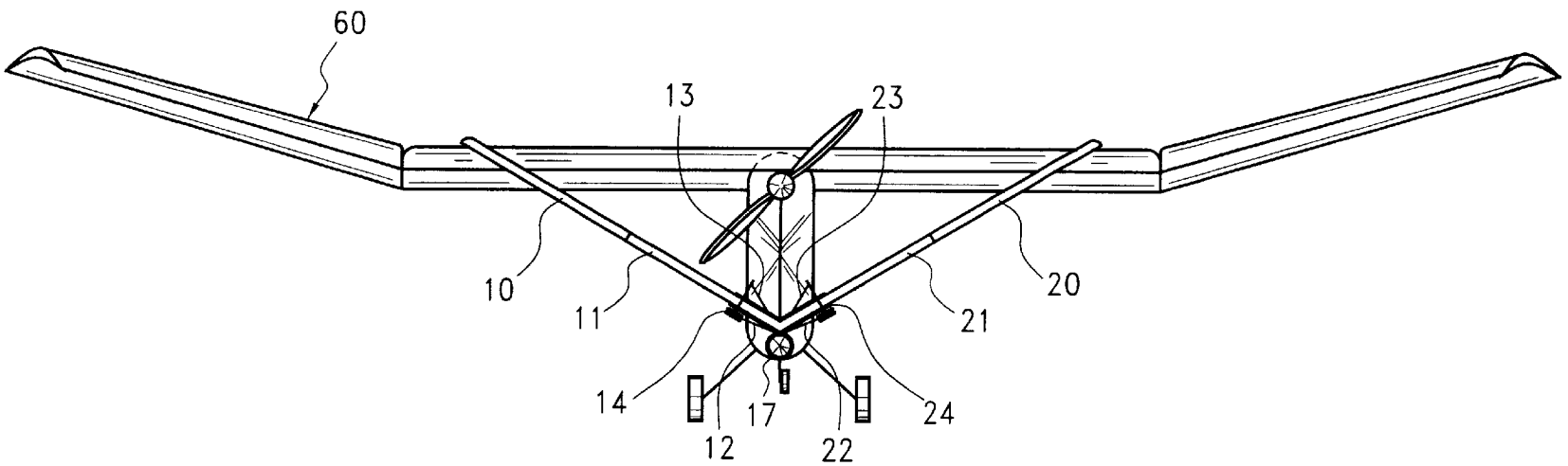
FIG. 8 is a rear view of the structure in FIG. 6.
Figure 9:
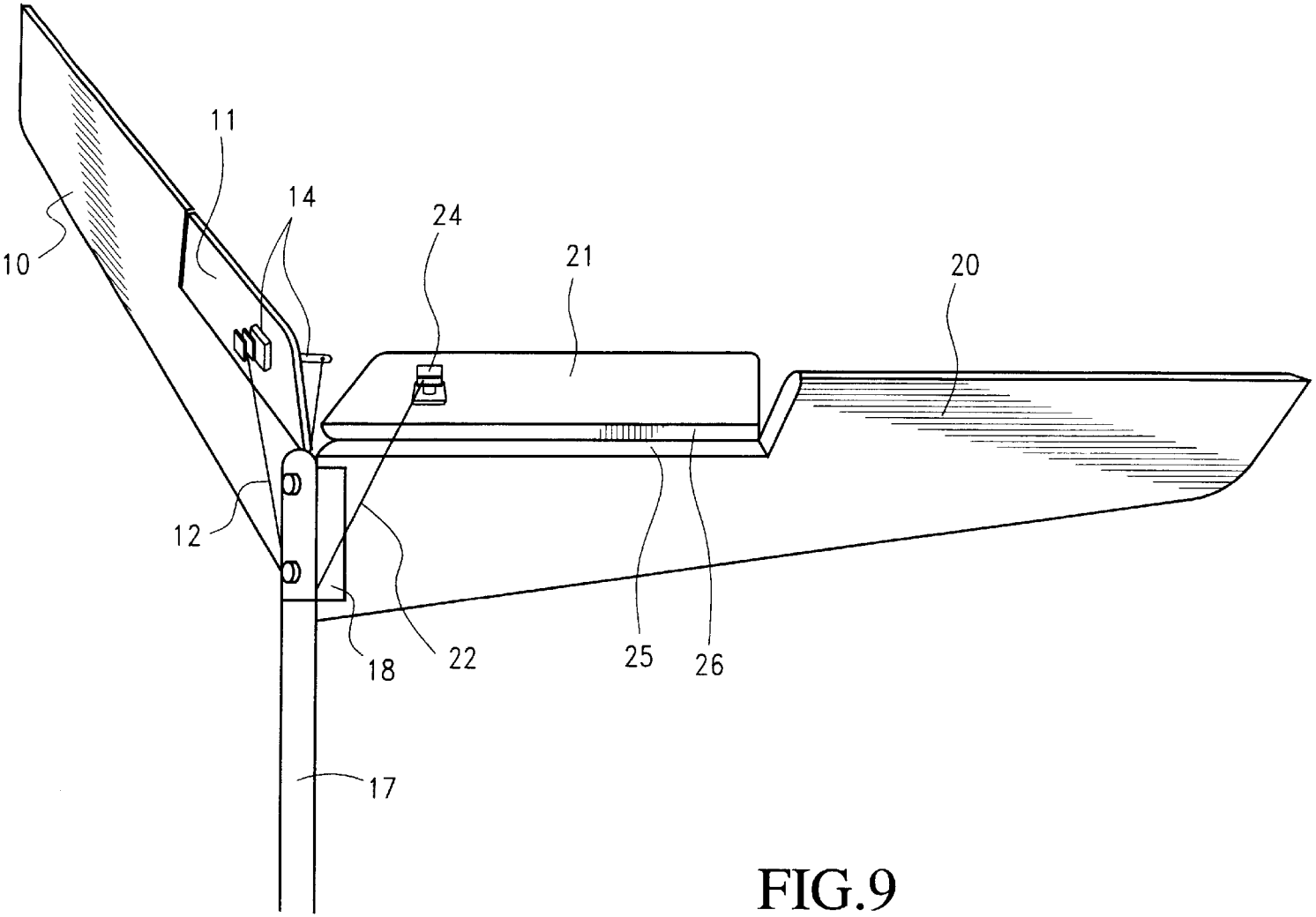
FIG. 9 is an enlarged perspective view of the empennage during left turn for the embodiment shown in FIG. 6.
Figure 10:
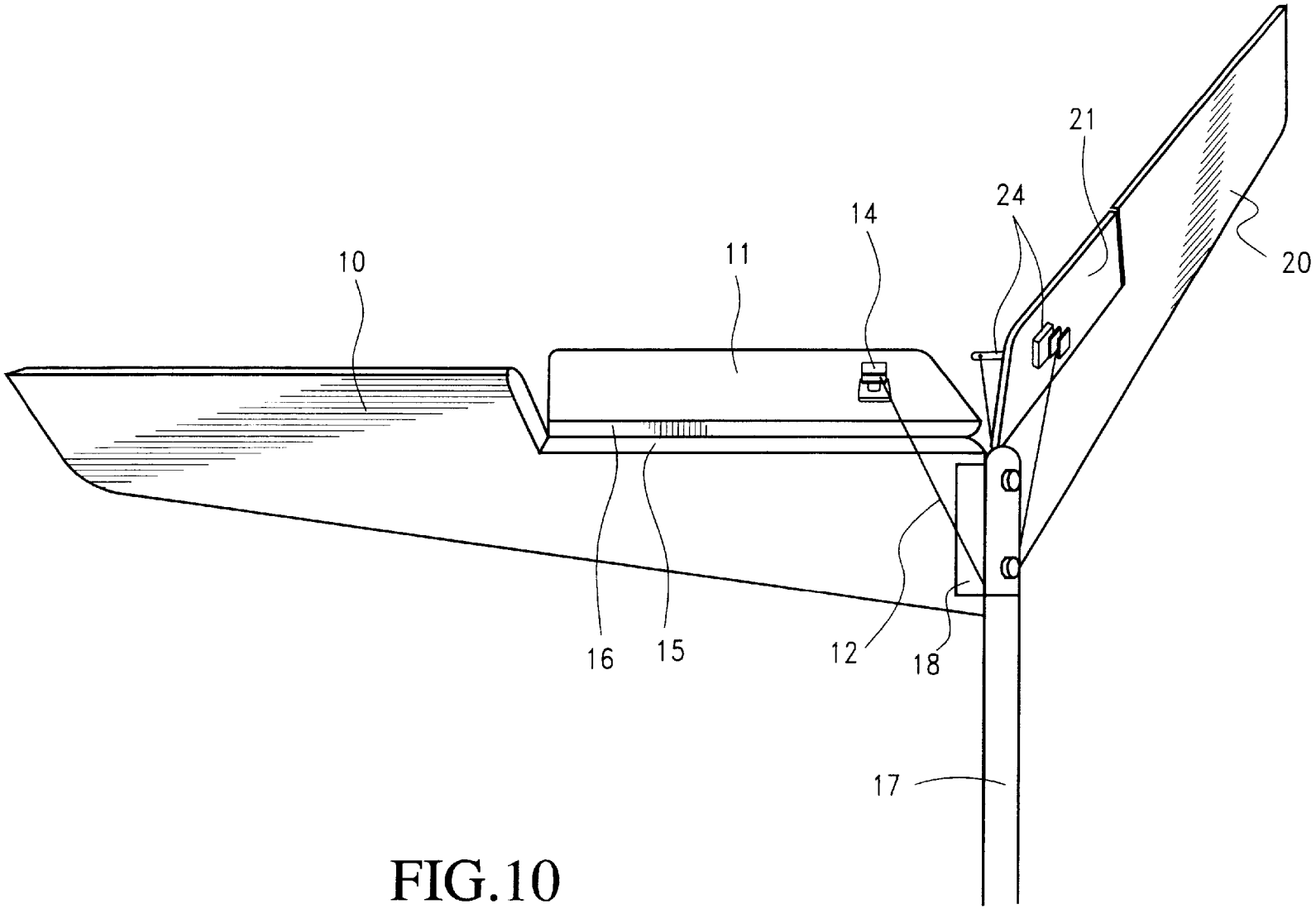
FIG. 10 is an enlarged perspective view of the empennage during right turn for the embodiment shown in FIG. 6.

When the aeroplane is turning right, as shown in FIG. 1 and FIG. 5, the rudder turns in clockwise by the control from the remote receiving device 40, the desired right turn can be achieved by the operations opposite to those in the left turn process described above.

Another embodiment of the invention as shown in FIG. 6~FIG. 10 is characterized in that the restoration mechanism is a single rubber band with its one end connected to the lower section of rudder surface for the left rack 14 and another end connected to the lower section of rudder surface for the right rack 24 through the front of the tail rack 18 fixed between the tail pole 17 and the joint of left and right empennages. Thus, the rubber band is divided into a left part 12 and a right part 22. The fly operations of this embodiment are similar to those in the above embodiment.

In both embodiments described above, the servos can be replaced by two electromagnets, and the flexible cable can be replaced by a nylon wire. Moreover, the operation principle of the invention will be described in below. Namely, there are two resolution forces from the air force acting on the turn rudder surface when the aeroplane turns: a horizontal force perpendicular to the body to turn the aeroplane; and a downward force perpendicular to the body. It is the later that provides a lift up to the head of aeroplane to ensure a smooth turning of the aeroplane without spiral down.

What is claimed is:

1. A remote-controlled electro-aeroplane, comprising:

a body;

a wing attached to said body;

a propeller connected to said body;

a remote receiving device attached to said body for receiving a remotely transmitted signal, and including a servo that controls a flight of the electro-aeroplane in response to the remotely transmitted signal; and V-type empennage attached to said body, including:

a left tail stabilizer and a right tail stabilizer that together form a V-shape;

a left turn rudder connected to said left tail stabilizer, and a right turn rudder connected to said right tail stabilizer;

a layer of plastic film attached on an upper surface of said left tail stabilizer, an upper surface of said right tail stabilizer, an upper surface of said left turn rudder and an upper surface of said right turn rudder, said plastic film jointing said left tail stabilizer to said left turn rudder, and jointing said right tail stabilizer to said right turn rudder;

left rack disposed on said left turn rudder and a right rack disposed on said right turn rudder;

a left flexible cable having one end connected to said left rack and another end connected to said servo, and a right flexible cable having one end connected to said right rack and another end connected to said servo, said servo being activatable to pull said left flexible cable thereby causing said left turn rudder to pivot in a first direction relative to said left tail stabilizer, said servo further being activatable to pull said right flexible cable thereby causing said right turn rudder to pivot in the first direction relative to said right tail stabilizer; and a restoration mechanism attached to said left turn rudder and to said right turn rudder, said restoration mechanism causing said left turn rudder and said right turn rudder to pivot in a second direction that is opposite to the first direction when said servo is not activated.

2. The remote electro-aeroplane of claim 1, wherein said restoration mechanism comprises left and right elastic bands, said left elastic band having one end fixed on a lower face of said left tail stabilizer and having another end fixed on a lower face of said left turn rudder, said right elastic band having one end fixed on a lower face of said right tail stabilizer and having another end fixed on a lower face of said right turn rudder.

3. The remote electro-aeroplane of claim 1, wherein said restoration mechanism is a single rubber band having one end connected to a further left rack disposed on a lower surface of said left turn rudder, another end connected to a further right rack disposed on a lower surface of said right turn rudder, and an intermediate portion attached to a tail rack fixed between a tail pole and a joint of said left and right tail stabilizers.

4. The remote electro-aeroplane of claim 1, wherein said servo comprises two electromagnets.

5. The remote electro-aeroplane of claim 1, wherein said flexible cable comprises a nylon wire.

6. The remote electro-aeroplane of claim 1, wherein an edge face of said left tail stabilizer is abuttable against an edge face of said left turn rudder to act as a pivot stop, and an edge face of said right tail stabilizer is abuttable against an edge face of said right turn rudder to act as a pivot stop.

7. The remote electro-aeroplane of claim 1, wherein said left tail stabilizer, said right tail stabilizer, said left turn rudder and said right turn rudder are formed from an elastic foam.

* * * * *